US006868565B2

(12) United States Patent
Frey

(10) Patent No.: US 6,868,565 B2
(45) Date of Patent: Mar. 22, 2005

(54) BED INCLUDING USER ADAPTABLE SUPPORT STRUCTURE

(76) Inventor: David J. Frey, 1143 James Ct., Lafayette, CO (US) 80026

( * ) Notice: Subject to any disclaimer, the term of this patent is extended or adjusted under 35 U.S.C. 154(b) by 0 days.

(21) Appl. No.: 10/430,454

(22) Filed: May 8, 2003

(65) Prior Publication Data

US 2004/0221390 A1 Nov. 11, 2004

(51) Int. Cl.[7] ..... A47C 23/24

(52) U.S. Cl. ..... 5/190; 5/191; 5/186.1; 5/120; 5/111; 5/724

(58) Field of Search ..... 5/110, 111, 190, 5/192, 120, 122, 123, 124, 126, 101, 105, 106, 186.1, 191, 211, 212, 638, 724, 215–219, 241, 727, 728; 297/284.2, 452.63

(56) References Cited

U.S. PATENT DOCUMENTS 2,391,746 A 12/1945 Schenker
2,788,531 A * 4/1957 Dye et al. ..... 5/191
3,126,553 A * 3/1964 Zastera ..... 5/233
3,129,441 A * 4/1964 Zastera et al. ..... 5/233
3,346,891 A * 10/1967 Cundiff ..... 5/220
3,719,962 A * 3/1973 Burkley ..... 5/604
3,797,054 A * 3/1974 Sly ..... 5/101
4,769,864 A * 9/1988 Park ..... 5/190
4,837,878 A * 6/1989 Huemer ..... 5/191
5,829,080 A * 11/1998 Robillard et al. ..... 5/638
5,878,451 A * 3/1999 Lumine ..... 5/191
6,311,570 B1 11/2001 Niedermuhlbichler

* cited by examiner

*Primary Examiner*—Michael Trettel
(74) *Attorney, Agent, or Firm*—Harold A. Burdick

(57) ABSTRACT

A bed including user adaptable sleep support structure is disclosed, the support structure having a frame and a plurality of flexible support straps anchored between side members of the frame in selected spaced relationships relative to one another, a number of unsupported areas of different widths thus being defined between selected adjacent straps. Adjusting buckles are located at each of the support straps accommodating individual length adjustment of each strap. The support straps together provide the sole body weight support in the support structure.

20 Claims, 5 Drawing Sheets

BED INCLUDING USER ADAPTABLE SUPPORT STRUCTURE

FIELD OF THE INVENTION

This invention relates to sleep supports for the human body, and, more particularly, relates to beds made adaptable for individual users.

BACKGROUND OF THE INVENTION

Heretofore, traditional beds have employed the mattress to enhance user comfort, and designers have done their best to develop a comfortable cushion between a flat surface and a user's curved body. Additionally, mattress supports have been attended to, a flat support (box spring, bed board or the like) for the mattress being typically preferred. Using traditional beds, the heaviest parts of the body and those that protrude (such as the shoulders, hips and knees) sink more into the mattress than other body parts. As a result, it is known that certain parts of the body support more of the body's weight in a traditional bed than other parts, creating uncomfortable pressure points and thus frequent movement of the body during sleep to relieve the pressure.

Various means for making body sleep supports more adaptable to the human body have been heretofore suggested and/or utilized (see, for example, U.S. Pat. No. 2,788,531). Some have included mechanisms for adjustability of the sleep support to individualize comfort and/or for therapeutic applications (see U.S. Pat. Nos. 4,837,878, 2,391,746 and 6,311,570, for example). However, such heretofore known and/or utilized sleep supports have not provided systems wherein consideration is given to the best anatomical position and spacing of the user's vertebrae (which can result in pinched nerves and tightening of the associated muscles), have not been readily adjustable to individual support and comfort needs along the entire body length, have over-supported some body parts, and/or have not recognized the need to accommodate movement of the user during sleep. Further improvements in the field of beds and related sleep supports could thus still be utilized.

SUMMARY OF THE INVENTION

This invention provides improved beds and sleep support structures therefore, the bed adaptable and readaptable to any particular user and attentive to optimal position and spacing of a user's vertebrae. The support structure is readily adjustable to individual support and comfort needs along the entire body length, minimizes impingement at heretofore over-supported body parts, and accommodates movement of the user during sleep. The support structure is configured with the capability for subtle support and/or comfort adjustments by a user so that the support structure (and/or a mattress positioned thereon) is curved to fit the particular user's body without the spine being twisted, particularly in the areas of the user's waist and neck.

The sleep support structure for the bed includes a frame having head and foot members and opposite side members. A plurality of flexible supports (for example, straps) are anchored between the side members in selected spaced relationships relative to one another, thus providing a number of unsupported areas with some unsupported areas being larger than others as defined by selected adjacent ones of the supports being spaced a greater distance from one another than other adjacent ones of the supports.

Adjusters at the supports accommodate individual length adjustment of each of the supports, the supports together providing the sole body weight support in the support structure. Each of the supports has spaced first and second releasable engaging surfaces thereat, spacing retainers being operatively associable with the engaging surfaces for maintaining support spacing and orientation. A flexible pad may be positioned over at least some of the supports.

The foot and head members of the frame are preferably provided with curved lower floor engaging surfaces that allow for rocking of the support structure responsive to changes in position of a user on the support structure.

It is therefore an object of this invention to provide improved beds and sleep support structures therefore.

It is another object of this invention to provide a bed and related sleep support structure that is adaptable and readaptable to any particular user and attentive to optimal position and spacing of a user's vertebrae.

It is still another object of this invention to provide a support structure for a bed that is readily adjustable to individual support and comfort needs along the entire body length, minimizes impingement at heretofore over-supported body parts, and accommodates movement of the user during sleep.

It is yet another object of this invention to provide a support structure for a bed including a frame having opposite side members, and a plurality of flexible supports anchored between the side members and spaced relative to one another, the supports together providing the sole body weight support in the support structure, selected adjacent ones of the supports being spaced a greater distance from one another than other adjacent ones of the supports thereby providing relatively unsupported areas at the greater distance.

It is still another object of this invention to provide a bed with user adaptable support structure including a frame having head and foot members between opposite side members, a plurality of straps anchored between the side members and spaced relative to one another, the straps together providing the sole body weight support, selected adjacent ones of the straps being spaced a greater distance from one another than other adjacent ones of the straps thereby providing relatively unsupported areas at the greater distance, each of the straps having spaced first and second releasable engaging surfaces thereat, first and second spacing retainers, the first spacing retainer operatively associable with at least some of the first engaging surfaces of the straps and the second spacing retainer operatively associable with at least some of the second engaging surfaces of the straps for maintaining strap spacing and orientation, adjusting means operatively associated with the straps for length adjustment of the straps between the side members, and a flexible pad positioned over at least some of the straps.

It is yet another object of this invention to provide a support structure for a bed including a frame having opposite side members, a foot member and a head member, the foot and head members having curved lower surfaces providing floor engagement allowing for rocking of the support structure responsive to changes in position of a user on the support structure, a plurality of straps anchored between the side members of the frame and spaced relative to one another, selected adjacent ones of the straps being spaced a greater distance from one another than other adjacent ones of the straps, adjusting means at the straps for accommodating individual length adjustment of the straps between the side members, and position retention means releasably associated with the straps for maintaining selected strap spacing and strap orientation.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
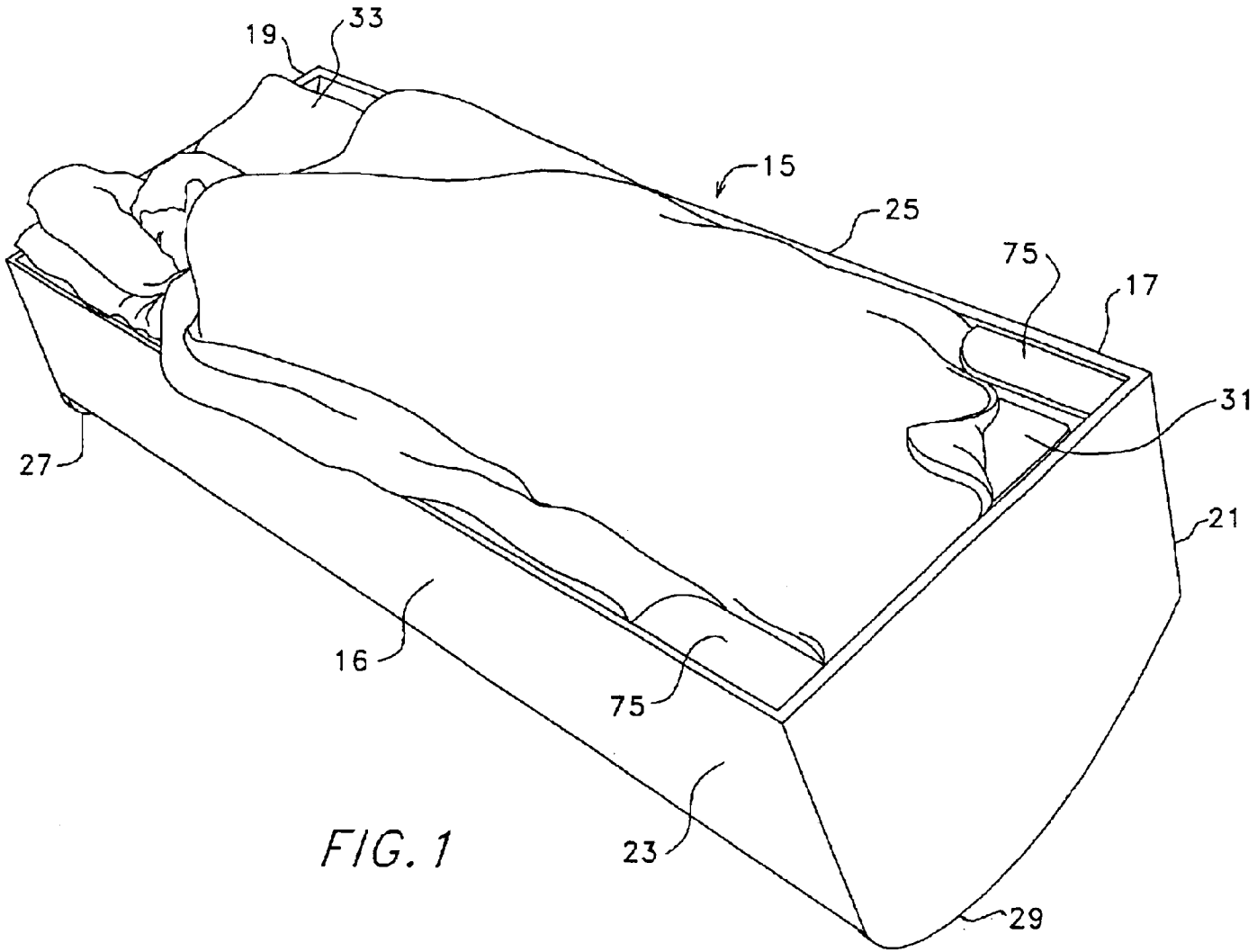
FIG. 1 is a perspective view of the adaptable bed of this invention.

Bed 15 of this invention is illustrated in FIG. 1 in use. Bed 15 includes support structure 16 with frame 17 having head member 19, foot member 21 and side members 23 and 25. Head and foot members 19 and 21 have floor engaging lower surfaces 27 and 29, respectively, that are curved to allow for rocking of the bed responsive to attempted turning movements of the occupant. Other means allowing the bed to responsively rock could be employed as would be apparent from the following descriptions. Bed 15 may also utilize mattress 31 and pillow 33.

Figure 2:
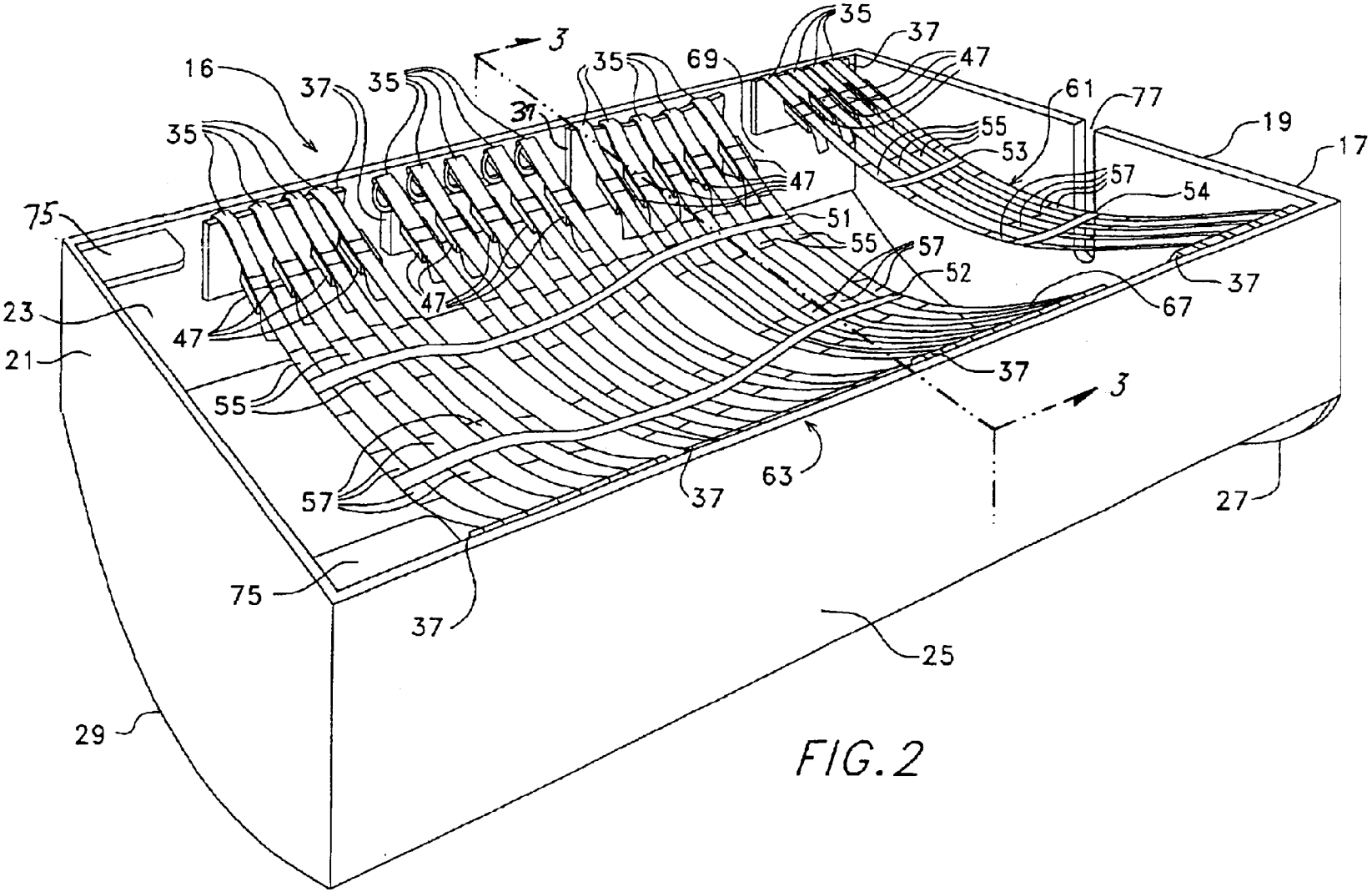
FIG. 2 is a perspective view of the support structure of the bed shown in FIG. 1.
Figure 3:
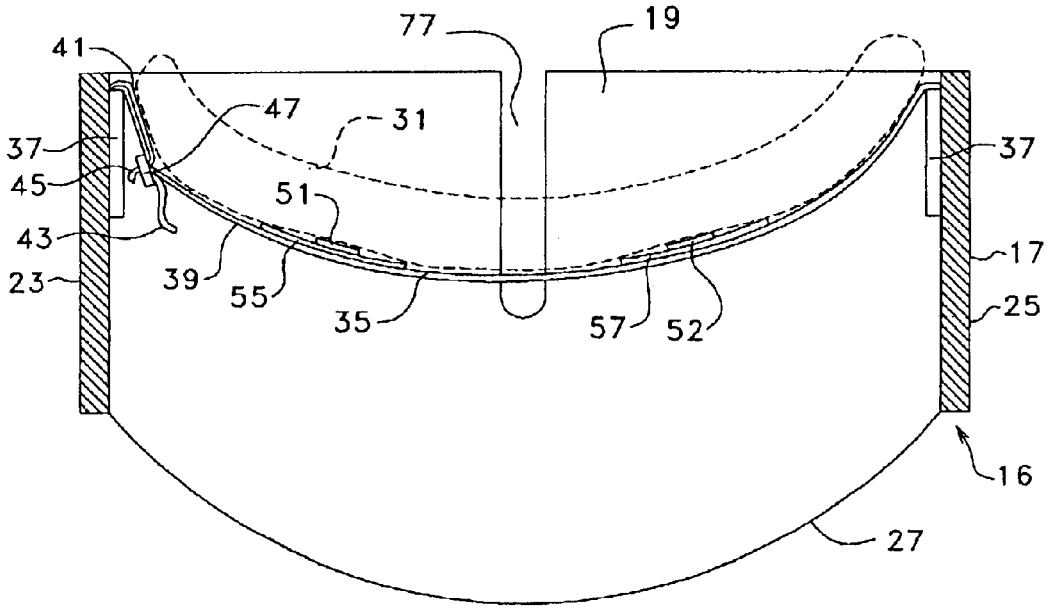
FIG. 3 is a sectional view taken through section lines 3—3 of FIG. 2.

Turning to FIGS. 2 and 3, support structure 16 further includes a plurality of flexible supports 35. Supports 35 are preferably straps, or webbing, capable of supporting expected loads (for example, up to about 500 pound loads with strap widths of about 1.5 inches). While straps are preferred, other supports such as ropes, cords, cables, or the like could be utilized. Supports 35 are anchored between side members 23 and 25 (for example by clamping, screwing, gluing or the like beneath mounting boards 37 affixed to side members 23 and 25). For purposes of this embodiment, each support 35 includes strap sections 39 and 41 (see FIG. 3), one end of each anchored at different side members 23 or 25 and the other ends of each (43 and 45, respectively) joined by adjusting buckles 47. These releasable locking buckles 47 accommodate individual length adjustment of each and every one of supports 35 (by shortening or lengthening strap sections 39) between side members 23 and 25. Supports 35 should be long enough so that they can be adjusted with the supports quite low in the frame. This lower setting may be preferred by many since such a setting allows supports 35 and or mattress 31 to actually surround the body, spreading body weight over a larger contact area and thereby reducing pressure on any given body area.

Buckles 47 may be any of several types of such hardware commonly utilized for the purpose. Moreover, additional support adjusting features could be employed including motorized strap adjusters, the use of ohmmeters to automatically adjust tension, deployment of tension measuring devices with readouts, and various set point schemes for strap tension setting.

The spacing (relative to one another) and orientation of supports 35 is adjustably maintained by support retention strips 51, 52, 53 and 54 (VELCRO hook material strips may by utilized, for example) in cooperation with engaging strips 55 and 57 connected at each support 35 (matable VELCRO loop material strips may be utilized). Strips 55 and 57 are positioned at each support 35 to preferably leave a body engaging surface of supports 35 (i.e., the middle expanse of sections 39) therebetween thus avoiding discomforting surface discontinuities below a user and allowing for the surface therebetween to flatten under user load (while fewer retention strip combinations is not preferred, a greater number may be utilized). The pillow support grouping (61) and body support grouping (63) of supports 35 are preferably separately retained for ease of spacing adjustments at the different support groupings. Support spacing may be changed merely by disengaging the strips and repositioning the supports before reengagement. This arrangement also allows for maintenance of continuity of adjacent supports 35 at different relative heights after adjustment.

The grouping of supports 35 accommodates greater spacing distances between selected adjacent supports leaving unsupported areas where support is unnecessary and would be uncomfortable to a user (and often detrimental to sleep posture). For example, between the head neck area (at grouping 61) and upper torso area (at one end 67 of grouping 63), a larger distance 69 between adjacent ones of supports 35 (relative to the distance between other adjacent ones of supports 35) is provided to allow maximum freedom from impingement on, and, where desired, even free movement therebetween of, the arms and shoulders, completely freeing the user of the bed from pressure thereat (a common source of discomfort and sleep disturbance).

Figure 5:
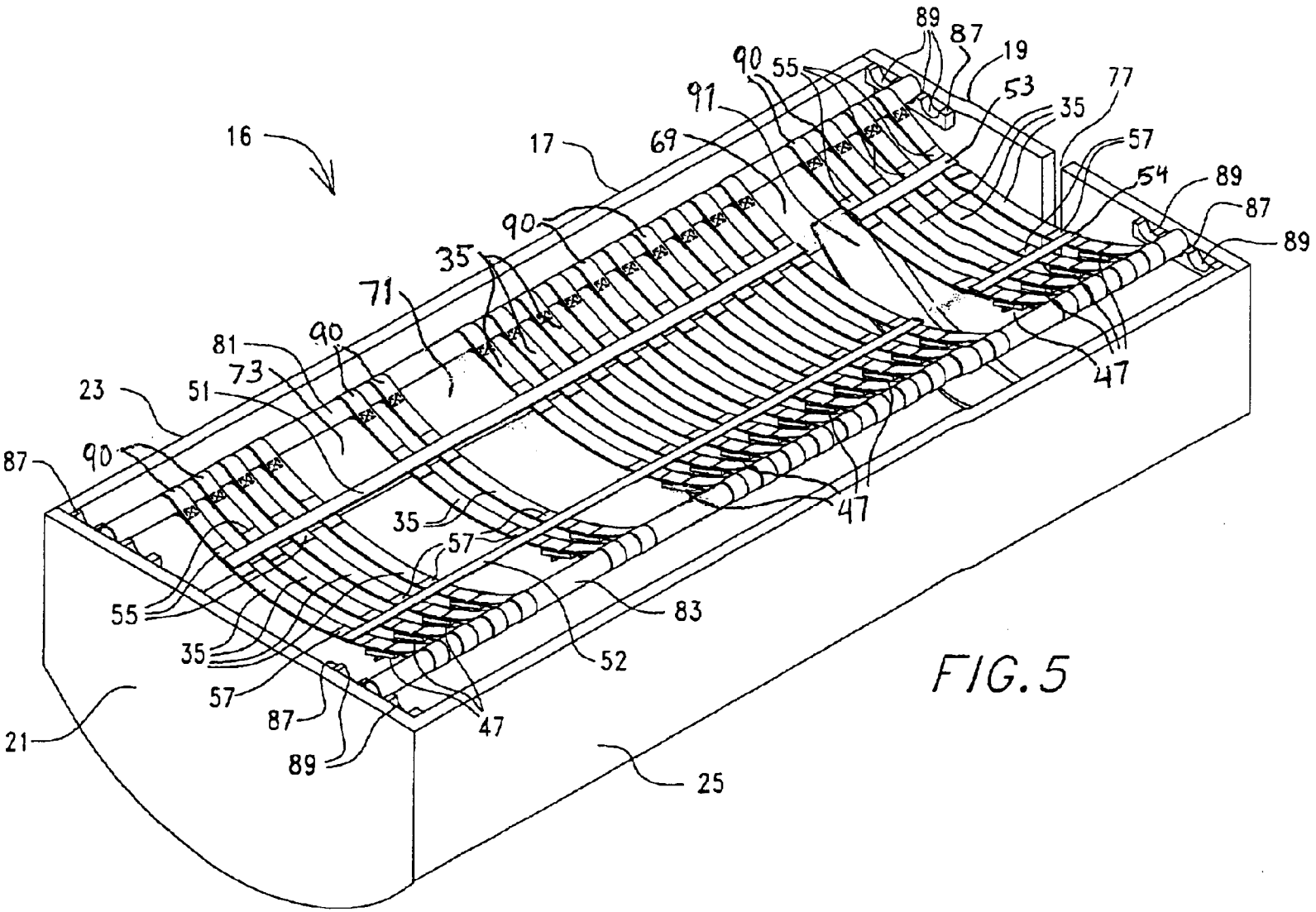
FIG. 5 is a perspective view illustrating a second embodiment of the support structure of the bed shown in FIG. 1.

Other spacing variations may be utilized (see, for example, FIG. 5 wherein unsupported distances 71 and 73 are provided between adjacent supports 35, leaving unsupported areas at the thigh and calves, respectively, of a user where support is unnecessary, while supporting the hips, knees and ankles). In such cases, retention strips 51 and 52 may be divided into sections for ease of readjustment of supports 35 in support groupings between the larger distances.

Support structure 16 is provided with blanket and sheet retainers 75 at the corners of frame 17. Carbon dioxide exhaust slot 77 is provided at head member 19 of frame 17 to allow for circulation of gasses away from the area. Together with the openness of frame 17 (particularly in the area below mattress 31 which should be free of frame structure), free circulation of air around a user's head is promoted thereby.

Figure 4:
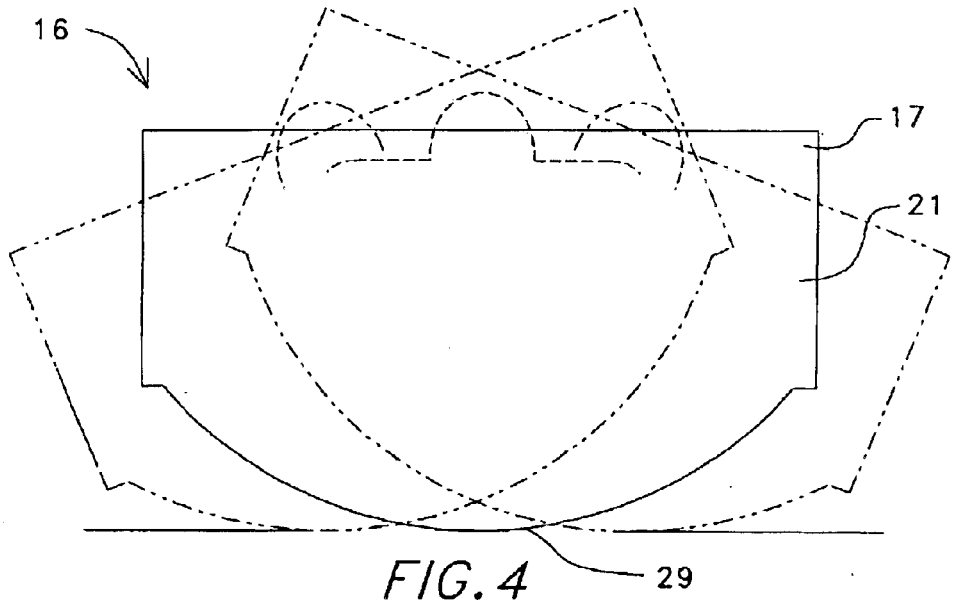
FIG. 4, is an illustration of the rocking feature of the support structure of FIG. 2.

As illustrated in FIG. 4, when a user sleeping on support structure 16 attempts to turn (shifting weight to one side or the other of frame 17), the entire structure 16 tilts to that side. This allows the sleeping user the sensation of having rolled while the position and support of the user's body may actually be unchanged in support structure 16 in most cases. Thus the alignment at the user's spine and support adaptation to the particular body type selected by adjustment of supports 35 remains effective while the normal sleep patterns of the user are accommodated.

Supports 35 are effective to support a body even without a mattress 31. The supports conform and surround the body so that body weight is distributed evenly and over a greater area of the body, thereby making a mattress unnecessary for some users. A mattress 31 is, however, probably preferable for most users, and any pad that is flexible is acceptable (including air or water mattresses, though a relatively soft and compliant foam mattress has been found to be quite adequate). If mattress 31 is not flexible it won't conform to the body, and it is this characteristic of adaptability to the user's body of supports 35 (and mattress 31 where used) that provides the degree of comfort afforded the wide range of different users' body types and comfort/therapeutic needs.

In use, the user adjusts supports 35 exactly to positions desired and depending upon the preferred sleep posture (stomach, side, back, or combination). Thus support structure 16, by adjustment of the height settings of each support 35, may be customized for each user. For example, settings allowing a user to lay face down must consider spine position. The highest support 35 should, therefore, be under the top of the user's hips. This tends to rotate the hips backward to relieve the pressure at the small of the back. With the hips high (and supports 35 along the spine properly adjusted), the body weight tends to stretch the small of the back and keep the user's fifth lumbar in place. Support 35 lengths are selected so that positions are adjustable over a range of elevations variable in excess of six to 20 inches.

FIG. 5 illustrates a second embodiment of support structure 16 wherein side members 23 and 25 comprise dual separate parts including the outer frame members and support anchoring bars 81 and 83, respectively. Bars 81 and 83 are retained at multiposition supports 87 (a pair at each of the head and foot members 19 and 21, respectively, of frame 17, each pair being aligned with the pair opposite). Each support 87 receives an end of bars 81/83 thereat in a selected one of several receiving slots 89 (three shown herein though more or fewer could be utilized). Bars 81/83 are thus movable by a user to different relative spacings effectively adjusting the width of the sleeping space (and thereby allowing supports 35 to more closely or less closely surround a particular user). Support straps 35 are maintained around bars 81/83 and held by adjustment buckles 47 (only a single strap section is thus needed in this embodiment for each support 35).

While supports 87 at head and foot members 19 and 21 are illustrated herein, such supports could be mounted at side members 23/25. Moreover, while a single bar 81/83 is shown at each side, multiple bars could be used at each side for different width settings along different portions of the body (for example, providing more room at the head while providing a more snug fit at the hips and/or back).

Support straps 35 may be long enough that only a single buckle 47 at each support is necessary, or may be shortened with buckles utilized at both ends (at each bar 81 and 83) of support strap 35 or at only one end around one of the bars 81/83 (in which case loops 90 would be sewn in each strap 35 at the opposite end for receipt therethrough of the other one of bars 81/83 (as shown in FIG. 5). In either case, selected repositioning and respacing of straps is readily accommodated by sliding of support straps along bars 81 and 83, to adapt the support structure to user's bodies of different heights for example. The greater distances (69, 71 and 73, for example) between adjacent supports 35 may be expanded, contracted, or relocated by this means. Once configured, retention strips 51, 52, 53, 54, and engaging strips 55 and 57 are reengaged to preserve spacing and orientation of support straps 35.

An optional rigid or semi-rigid arm support 91 is also shown in FIG. 5 attached between side members 23 and 25 to provide a rest for the lower arm of an occupant of the bed if desired and/or to provide a leverage support enabling more ready body movement by the occupant when desired. Support 91 may be configured as either a flat or curved structure, and may be made of any rigid or semi-rigid material (wood, metal, plastic, or heavy material webbing). Support 91 should be attached to frame 17 so that it is located at a position below supports 35 adjacent thereto when such supports 35 are set at their lowest positions (at least two inches below the lowest position setting). Support 91 is preferably between six and 12 inches wide.

Figure 6:
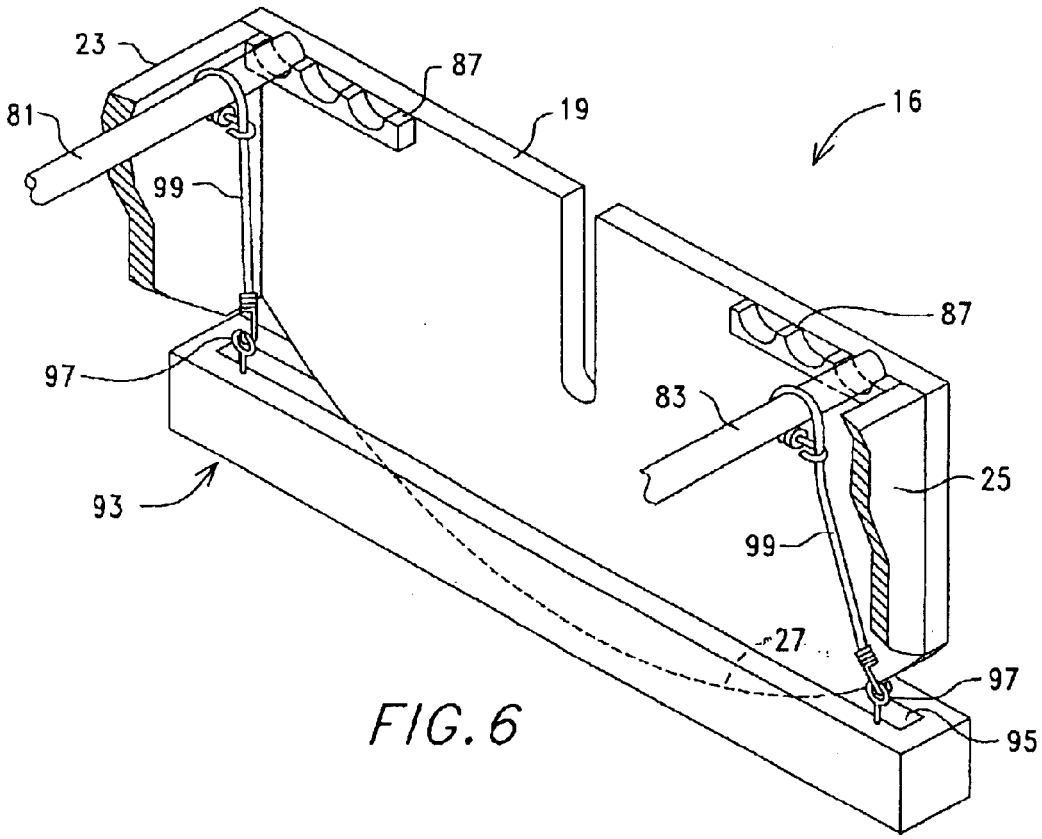
FIG. 6 is a perspective view illustration showing an additional feature utilizable with the support structure for the bed of FIG. 1.

FIG. 6 shows use of frame rocking damping structures 93 at head and foot members 19 and 21 (for ease of description: only structure 93 at head member 19 is shown, the structure 93 at foot member 21 being a mirror image thereof; and supports 35 have been removed in FIG. 6). Channels 95 are defined in each structure 93 for receipt of lower rocking surfaces 27 and 29 of members 19 and 21, respectively. Eye bolts 97 are attached at the ends of structures 93, and elastic cords 99 are affixed to the eye bolts, extended through frame 17 and engaged with side members 23/25 (at bars 81/83 for example, or other arrangement made for such purpose). The length, diameter and elasticity of cords 99 is selected depending upon the degree of bed rocking damping desired (damping may be made adjustable by providing additional attachment points at members 19/21/23/25).

Figure 7:
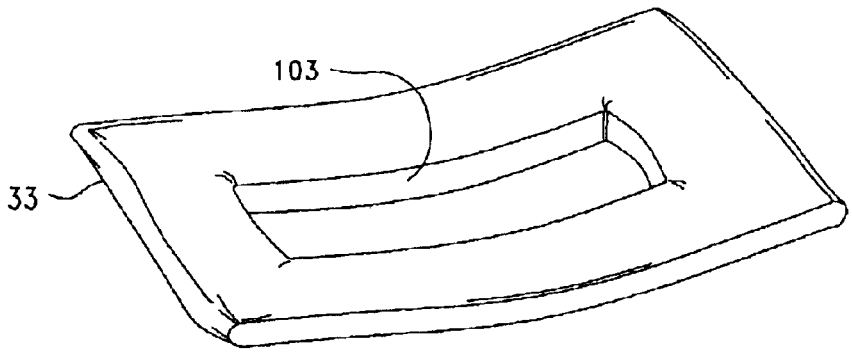
FIG. 7 is a perspective view of the pillow preferably utilized with the bed of this invention.

FIG. 7 illustrates pillow 33 preferred for use with bed 15 of this invention. Pillow 33 is a standard foam or filled pillow of selected firmness and Size, but having central breathing slot 103 formed therein. Slot 103 provides for free movement therethrough of air to a user (particularly when sleeping face down, allowing a sleeping posture that does not require twisting of the neck) and movement away from a user of exhaled carbon dioxide. In combination with features discussed hereinabove (open frame 17 structure and slot 77 at head member 19 of frame 17), pillow 33 thus promotes maximization of oxygen intake of a user during sleep.

As may be apparent from the foregoing, a double bed structure could be realized utilizing the teachings herein. In such case, a center bar (similar to bars 81/83) would be added and supported between head and foot members 19 and 21 to support the separate supports 35 arrays at each side of the bed. The center bar should in such case be vertically adjustable, and would preferably be horizontally adjustable also (between side members 23/25). A double bed arrangement would also preferably provide structure to allow responsive rocking of each side of the bed (independently of the other side of the bed).

What is claimed is:

1. A support structure for a bed comprising:

a frame having opposite side members; and a plurality of flexible supports anchored between said side members and spaced relative to one another, said supports together providing body weight support in said support structure, selected adjacent ones of said supports being spaced a greater distance from one another than other adjacent ones of said supports; and adjusters at said supports accommodating independent length adjustment of different ones of said supports between said side members.

2. The support structure of claim 1 wherein said supports together provide the sole body weight support in said support structure, and wherein relatively unsupported areas are provided at said greater distance between said selected adjacent ones of said supports.

3. The support structure of claim 1 wherein said selected adjacent ones of said supports are located at said frame to accommodate a user's shoulders at said greater distance therebetween.

4. The support structure of claim 1 further comprising position retention means associated with said supports for maintaining support spacing and orientation.

5. The support structure of claim 4 wherein said position retention means includes first and second spaced retaining strips oriented relatively perpendicular to said supports and releasably associable with cooperative structure at each of said supports.

6. The support structure of claim 1 further comprising support anchoring units maintained adjacent to said side members of said frame for releasably maintaining at least some of said supports therebetween.

7. The support structure of claim 6 wherein said frame includes multiposition retainers for releasably holding said anchoring units, said retainers configured for user selection of spacing of said anchoring units relative to one another.

8. A bed with user adaptable support structure comprising:

a frame having opposite side members;

a plurality of straps anchored between said side members and spaced relative to one another, said straps together providing the sole body weight support, selected adjacent ones of said straps being spaced a greater distance from one another than other adjacent ones of said straps thereby providing relatively unsupported areas at said greater distance, each of said straps having spaced first and second releasable engaging surfaces thereat;

first and second spacing retainers, said first spacing retainer operatively associable with at least some of said first engaging surfaces of said straps and said second spacing retainer operatively associable with at least some of said second engaging surfaces of said straps for maintaining strap spacing and orientation;

adjusting means operatively associated with said straps for length adjustment of said straps between said side members; and a flexible pad positioned over at least some of said straps.

9. The bed of claim 8 wherein said selected adjacent ones of said straps are located at said frame to accommodate one of a user's shoulders and a user's thighs at said greater distance therebetween.

10. The bed of claim 8 wherein said selected adjacent ones of said straps are located at said frame to accommodate a user's shoulders at said greater distance therebetween, said pad covering straps only at one side of said greater distance, said bed further comprising a pillow having a central breathing slot therethrough, said pillow positioned over straps and an opposite side of said greater distance from straps having said pad thereat.

11. The bed of claim 10 further comprising third and fourth spacing retainers, said first spacing retainer operatively associable said first engaging surfaces of said straps at said one side of said greater distance, said second spacing retainer operatively associable with said second engaging surfaces of said straps at said one side of said greater distance, said third spacing retainer operatively associable said first engaging surfaces of said straps at said opposite side of said greater distance, and said fourth spacing retainer operatively associable with said second engaging surfaces of said straps at said opposite side of said greater distance.

12. The bed of claim 8 wherein said frame includes a head member between said side members, said head member including an opening thereat allowing circulation of gasses from the vicinity of said head member.

13. The bed of claim 8 further comprising means for adjusting the width of sleeping space between said side members.

14. The bed of claim 8 wherein said frame is configured to allow tilting of the frame responsive to changes in position of a user in said bed.

15. A support structure for a bed comprising:

a frame having opposite side members, a foot member and a head member, said foot and head members having curved lower surfaces providing floor engagement allowing for rocking of said support structure responsive to changes in position of a user on said support structure;

a plurality of straps anchored between said side members of said frame and spaced relative to one another, selected adjacent ones of said straps being spaced a greater distance from one another than other adjacent ones of said straps;

adjusting means at said straps for accommodating individual length adjustment of said straps between said side members; and position retention means releasably associated with said straps for maintaining selected strap spacing and strap orientation.

16. The support structure of claim 15 wherein said position retention means includes first and second spaced retaining strips oriented relatively perpendicular to said straps and releasably associable with cooperative structure at said supports.

17. The support structure of claim 15 wherein said side members of said frame include strap anchoring bars for releasably maintaining at least some of said straps at selected positions therealong, said frame including multiposition retainers for releasably holding said anchoring bars at selected locations thereby accommodating user selection of spacing of said anchoring bars relative to one another.

18. The support structure of claim 15 wherein said adjusting means are buckles.

19. The support structure of claim 15 further comprising restricting means engagable at said frame for selected damping of support structure rocking.

20. The support structure of claim 15 wherein said head member of said frame includes an opening thereat allowing circulation of gasses from the vicinity of said head member.

* * * * *